US006507250B1

(12) United States Patent
Tada et al.

(10) Patent No.: US 6,507,250 B1
(45) Date of Patent: Jan. 14, 2003

(54) DIELECTRIC FILTER, DIELECTRIC DUPLEXER, AND COMMUNICATION EQUIPMENT

(75) Inventors: Hitoshi Tada, Ishikawa-ken (JP); Hideyuki Kato, Ishikawa-ken (JP); Motoharu Hiroshima, Ishikawa-ken (JP); Haruo Matsumoto, Kanazawa (JP)

(73) Assignee: Murata Manufacturing Co. Ltd. (JP)

( * ) Notice: Subject to any disclaimer, the term of this patent is extended or adjusted under 35 U.S.C. 154(b) by 0 days.

(21) Appl. No.: 09/374,476

(22) Filed: Aug. 13, 1999

(51) Int. Cl.[7] ..... H01P 1/213; H01P 1/202
(52) U.S. Cl. ..... 333/134; 333/202; 333/206
(58) Field of Search ..... 333/205, 202, 333/202 DB, 134

(56) References Cited

U.S. PATENT DOCUMENTS 4,673,902 A * 6/1987 Takeda et al. ..... 333/202
4,879,533 A * 11/1989 De Muro et al. ..... 333/202 X
5,010,309 A * 4/1991 Marssen et al. ..... 333/202 X
5,023,580 A * 6/1991 Kim et al. ..... 333/202 X
5,208,566 A * 5/1993 Kenoon et al. ..... 333/206
5,889,447 A * 3/1999 Newell et al. ..... 333/202
6,014,067 A * 1/2000 Matsumoto et al. .... 333/206 X

FOREIGN PATENT DOCUMENTS

JP 65601 * 4/1985 ..... 333/202 DB

* cited by examiner

*Primary Examiner*—Benny Lee
(74) *Attorney, Agent, or Firm*—Dickstein, Shapiro, Morin & Oshinsky, LLP.

(57) ABSTRACT

A dielectric filter or a dielectric duplexer is provided which comprises a dielectric block in a substantially rectangular parallelepiped shape, having a pair of opposite parallel end-faces and plural sides extending between the paired opposite end-faces, one of the plural sides being a mounting face; plural resonator holes elongating through the inside of the dielectric block across the paired opposite end-faces; inner conductors provided on the inner walls of the plural resonator holes, respectively; an outer conductor provided on the outside of the dielectric block; input-output electrodes provided only on one of the paired opposite end-faces, separated from the outer conductor, and capacitance-coupled to the predetermined inner conductors, respectively; and conductive terminals for external connection, connected to the input-output electrodes, having at least portions thereof lying substantially in the same plane as the mounting face. In the dielectric filter or the dielectric duplexer, since input-output electrode are provided on the end-face of the dielectric block, not provided on the sides of the dielectric block, the deterioration of Q0, caused by the input-output electrodes, can be reduced. Accordingly, the insertion loss and the attenuation characteristics are improved.

16 Claims, 4 Drawing Sheets

DIELECTRIC FILTER, DIELECTRIC DUPLEXER, AND COMMUNICATION EQUIPMENT

BACKGROUND OF THE INVENTION

1. Field of the Invention

The present invention relates to a dielectric filter and a dielectric duplexer each including plural inner conductors inside of a dielectric block, and an outer conductor on the outside of the dielectric block, and input-output electrodes which are capacitance-coupled to the predetermined inner conductors, respectively, and a communication apparatus using them.

2. Related Art

A conventional dielectric filter having plural resonator holes formed inside of a dielectric block has such a structure as shown in FIG. 8. In the figures shown below, the dot-shaded portion is the portion of the dielectric block which is visible.

In FIG. 8, the reference numeral 1 designates a dielectric block having a rectangular parallelepiped shape, in which three resonator holes 2*a,* 2*b,* and 2*c* are formed to elongate from one of the end-faces to the other end-face, and inner conductors 3*a,* 3*b,* and 3*c* are formed on the inner walls, respectively. An outer conductor 4 is formed on the outside (five faces) of the dielectric block 1 excluding the one end-side. In particular, the inner conductors 3*a* through 3*c* are separated from the outer conductor 4 in the one end-face so that the one end-face becomes an open end-face, and in the other end-face, are connected to the outer conductor 4 so that the end-face becomes a short-circuiting face. In the open end-face, coupling electrodes 5*a,* 5*b,* and 5*c* connected to the inner conductors 3*a,* 3*b,* and 3*c,* correspondingly, are formed, and input-output electrodes 6*a* and 6*b* are formed. The input-output electrodes 6*a* and 6*b* are formed adjacently to the coupling electrodes 5*a* and 5*c* lying oppositely. The input-output electrodes 6*a* and 6*b* are formed to extend onto one side (the upper side in FIG. 8) of the dielectric block 1 which is a mounting face. Outer conductor non-forming portions are provided so as to surround the input-output electrodes 6*a* and 6*b,* which are caused to separate from the outer conductor 4.

The dielectric filter comprises the three resonator stages which correspond to the inner conductors 3*a* through 3*c*. The respective resonators are coupled through capacitances produced between the coupling electrodes 5*a,* 5*b*, and 5*c,* and between the coupling electrodes 5*a,* 5*b,* and 5*c* and the outer conductor 4, and an external coupling is attained through an external coupling capacitance Ce produced between the input-output electrodes 6*a* and 6*b* and the corresponding coupling electrodes 5*a* and 5*c*.

However, in the above-described conventional dielectric filter, since the input-output electrodes are formed also on the mounting face (side) of the dielectric block, the result is deterioration of the Q0 of the resonator, so that the filter characteristics (insertion loss and attenuation characteristics) are damaged. This is because the lower the proportion of the outer sides of the dielectric block covered by the outer conductor, the more the Q0 is deteriorated. Especially, when the axial length (the length of the dielectric block) of the resonators is shorter with the use of higher frequencies, this Q0 deterioration is even worse.

SUMMARY OF THE INVENTION

To solve the above-described problems, a preferred embodiment of the present invention provides a dielectric filter and a dielectric duplexer each of which has good characteristics without the Q0 being deteriorated, and can be surface-mounted steadily and securely, and a communication apparatus using the same.

One preferred embodiment according to the present invention provides a dielectric filter and a dielectric duplexer each of which comprises a dielectric block in a substantially rectangular parallelepiped shape, having one pair of opposite end-faces and plural sides extending between the paired opposite end-faces, one of the plural sides being a mounting face; plural resonator holes elongating through the inside of the dielectric block across the paired opposite end faces; inner conductors provided on the inner walls of the plural resonator holes, correspondingly; an outer conductor provided on the outside of the dielectric block; input-output electrodes each provided only on one of the paired opposite end-faces, separated from the outer conductor, and capacitance-coupled to the predetermined inner conductors, respectively; and conductive terminals for external connection, connected to the input-output electrodes, having at least a part thereof lying substantially in the same plane as the mounting face.

The other preferred embodiment according to the present invention provide a dielectric filter and a dielectric duplexer each of which comprises a dielectric block in a substantially rectangular parallelepiped shape, having a pair of opposite end-faces and plural sides extending between the paired opposite end-faces, one of the plural sides being a mounting face; plural resonator holes elongating through the inside of the dielectric block across the paired opposite end-faces; inner conductors provided on the inner walls of the plural resonator holes, correspondingly; an outer conductor provided on the outside of the dielectric block; a beveling portion formed in the edge portion between the one of the paired opposite end-faces and the mounting face; and input-output electrodes formed to extend over the one of the paired opposite end-faces and the beveling portion, separated from the outer conductor, and capacitance-coupled to the inner conductors, correspondingly.

In the dielectric filter and the dielectric duplexer each having the above-described configuration, since the input-output electrodes are formed only on the end-face of the dielectric block or are formed to extend over the end-face and the beveling portion, the deterioration of Q0, caused by the input-output electrodes, is reduced. That is, the deterioration of Q0 is decreased, as compared with that caused by the input-output electrodes formed on the mounting face (the side) of the dielectric block as described in the conventional example. Further, with the conductive terminals connected to the input-output electrodes and the input-output electrodes formed to extend over the end-face and the beveling portion, surface-mounting on a circuit board can be achieved steadily and securely.

Further, by excluding the outer conductor on the mounting face in the vicinity of the input-output electrodes, short-circuiting between the input-output electrodes and the conductive terminals, and the outer conductor, caused by solder or the like applied at mounting, can be prevented.

Further, the communication apparatus of the present invention, since it is configured, including the dielectric filter or the dielectric duplexer having the above-described features, has improved characteristics.

Hereinafter, an embodiment of the dielectric filter according to the present invention will be described with reference to the attached drawings, in which like references denote like elements and parts.

DESCRIPTION OF THE PREFERRED EMBODIMENTS

The configuration of the dielectric filter according to the first preferred embodiment of the present invention will be described with reference to FIG. 1 and FIG. 2.

The dielectric filter of this embodiment includes a dielectric block 1 having substantially a rectangular parallelepiped (hexahedron) shape. The three resonator holes 2*a,* 2*b,* and 2*c* are formed to elongate through the inside of the dielectric block 1 across a pair of the opposite end-sides, and on the inner walls, the inner conductors 3*a,* 3*b* and 3*c* are formed, respectively, as shown in FIG. 1. The outer conductor 4 is formed on the other outside (five faces) excluding one end-face of the dielectric block 1.

Figure 1:
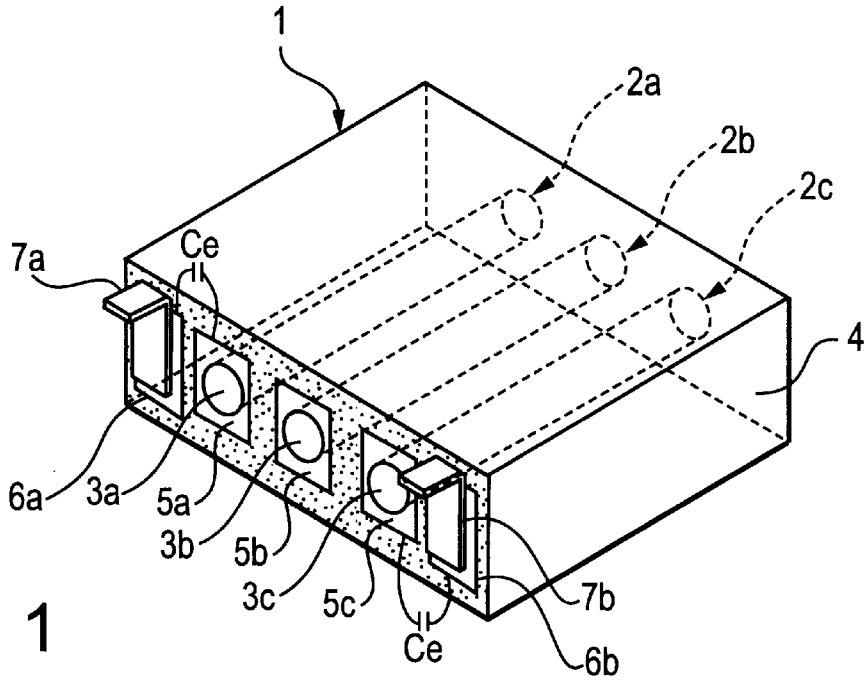
FIG. 1 is a perspective view of a dielectric filter according to a first preferred embodiment.
Figure 2:
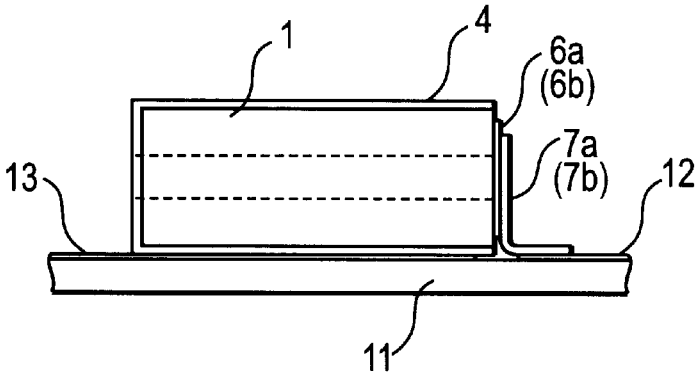
FIG. 2 is a cross-sectional view of the dielectric filter of FIG. 1 mounted onto a circuit board.

As best shown in FIG. 1, on the one end-face where the outer conductor 4 is not formed, the coupling electrodes 5*a,* 5*b,* and 5*c* connected to the respective inner conductors 3*a,* 3*b,* and 3*c* and separated from the outer conductor 4 are formed, and the input-output electrodes 6*a* and 6*b* are formed adjacently to the coupling electrodes 5*a* and 5*c* lying oppositely, respectively. In particular, the respective inner conductors 3*a,* 3*b* and 3*c* are separated from the outer conductor 4 in the one end-face (the end-face on the front side in FIG. 1) so that the one end-face becomes an open face for the respective resonators, and are connected (short-circuited) to the outer conductor 4 on the other end-face (the end-face on the back side in FIG. 1) so that this end-face becomes a short circuiting end-face.

In this embodiment, the input-output electrodes 6*a* and 6*b* are formed only on the opened face. To the input-output electrodes 6*a* and 6*b,* conductive terminals 7*a* and 7*b* for external connection are connected by soldering or the like. The conductive terminals 7*a* and 7*b* are formed by bending a metallic conductor plate into an L-character shape, and are attached so that the portions thereof protuberant from the dielectric block 1 lie substantially in the same plane as the one side (the upper side in FIG. 1) of the dielectric block 1 which is a mounting face.

The shape and size of the conductive terminals 7*a* and 7*b* is not limited to that of this embodiment. Any shape if at least a portion thereof protuberant outward lies substantially in the same plane as the mounting face is available. Further, for the input-output electrodes and the coupling electrodes, any shape and size is available, and when a large capacitance between the electrodes is to be produced, the opposing surfaces are formed in an interdigital shape.

The dielectric filter comprises three resonator stages which are formed by the inner conductors 3*a,* 3*b* and 3*c,* respectively. The respective resonators are coupled through the capacitances produced between the coupling electrodes 5*a,* 5*b,* and 5*c* and between the coupling electrodes 5*a*, 5*b*, 5*c*, and the outer conductor 4, and an external coupling is attained through an external coupling capacitance Ce (see FIG. 1) produced between the input-output electrodes 6*a* and 6*b* and the corresponding coupling electrodes 5*a,* 5*b* and 5*c*. Further, this dielectric filter is mounted on the circuit board 11 of a communication apparatus or the like as shown in FIG. 2. The conductive terminals 7*a* and 7*b* are connected to an input-output electrode pattern 12 on the upper side of the circuit board 11, and the outer conductor 4 on the mounting face to a grounded electrode pattern 13 on the upper side of the circuit board 11 by soldering or the like, respectively.

As described above, in the dielectric filter of this embodiment, since the input-output electrodes 6*a* and 6*b* are formed only on the end-face of the dielectric block 1, the deterioration of Q0, caused by the input-output electrodes 6*a* and 6*b,* is reduced. That is, the insertion loss and the attenuation characteristics of the dielectric filter are improved. The conduction terminals 7*a* and 7*b* are connected to the input-output terminals 6*a* and 6*b,* and thereby, the connection to the circuit board 11 is achieved through the conduction terminals 7*a* and 7*b,* so that the dielectric filter and the circuit board 11 can be connected steadily and securely.

Figure 3:
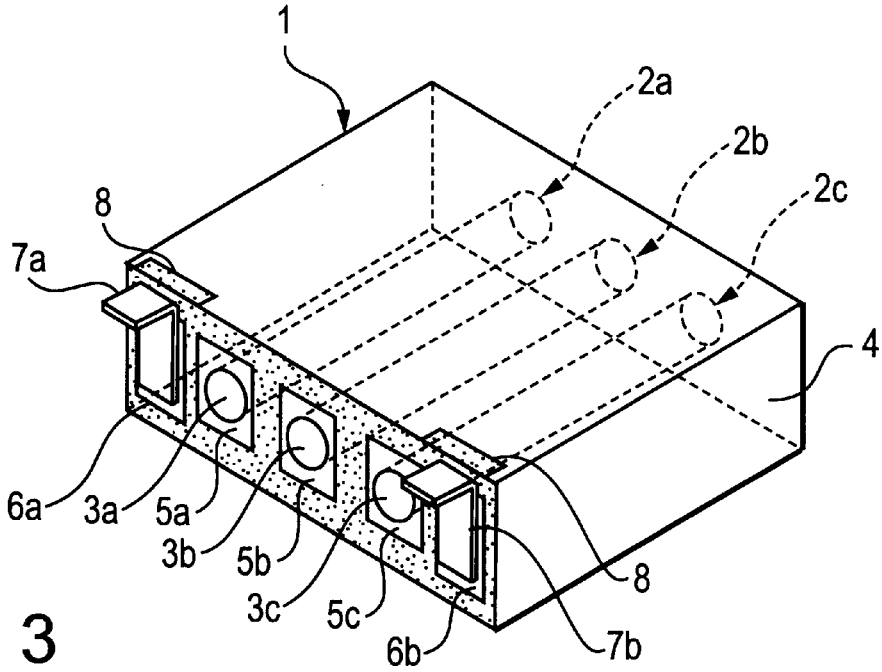
FIG. 3 is a perspective view of a dielectric filter according to a second preferred embodiment.

Then, the configuration of the dielectric filter according to the second preferred embodiment of the present invention is shown in FIG. 3. In this dielectric filter, the outer conductor 4 on the mounting face of the dielectric block 1 in the vicinity of the input-output electrodes 6*a* and 6*b* is partially excluded to form outer conductor non-forming portions 8 in continuity with the end-face. The configuration except for the above points is the same as that of the first embodiment as shown in FIG. 1. With this configuration, the short-circuiting between the conductive terminals 7*a* and 7*b,* and the outer conductor 4, caused by soldering or the like at mounting, can be prevented.

Figure 4:
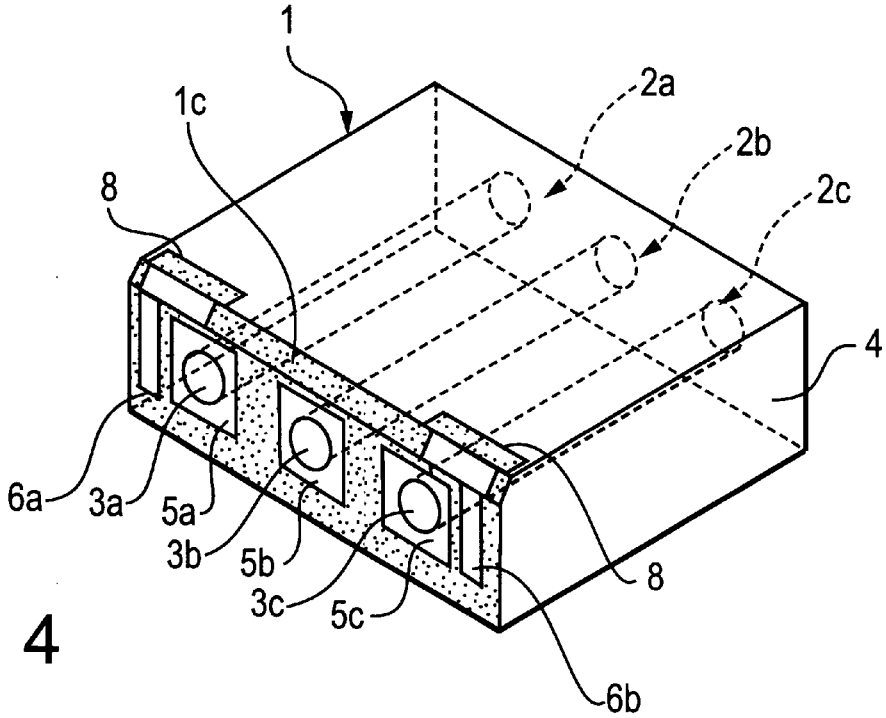
FIG. 4 is a perspective view of a dielectric filter according to a third preferred embodiment.
Figure 5:
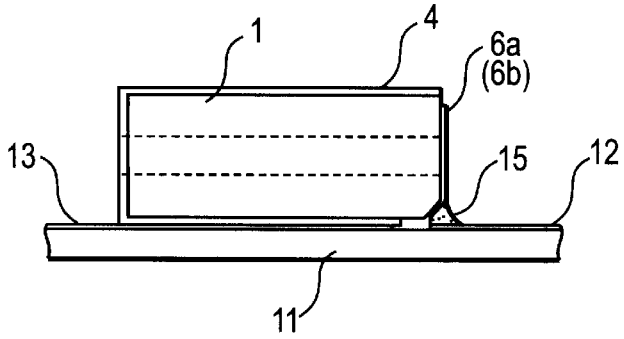
FIG. 5 is a cross-sectional view of the dielectric filter of FIG. 4 mounted on a circuit board.

Hereinafter, the configuration of the dielectric filter according to the third preferred embodiment of the present invention will be described with reference to FIG. 4 and FIG. 5.

This dielectric filter can be surface-mounted without the conductive terminals being used. By excluding the dielectric lying in the edge portion between the 6pen end-face and the mounting face of the dielectric block 1, this edge portion is beveled. The input-output electrodes 6*a* and 6*b,* formed on the open end-face, are extended onto the beveling portion 1*c* (see FIG. 4). That is, the input-output terminals 6*a* and 6*b* are formed to extend over the open end-face and the beveling portion 1*c*. The outer conductor 4 in the vicinity of the input-output electrodes 6*a* and 6*b* is partially excluded, so that the outer conductor non-forming portions 8 are formed in continuity with the end-face (see FIG. 4). The configuration excluding the above points is substantially the same as that of the above-described embodiment, and the description is omitted. This dielectric filter is mounted on the circuit board 11 as shown in FIG. 5. The portions of the input-output electrodes 6*a* and 6*b* formed on the beveling portion are soldered onto the input-output electrode pattern 12 lying on the upper side of the circuit board 11 by means of solder 15, and the outer conductor 4 on the mounting face is connected by soldering to the grounded electrode pattern 13 on the upper side of the circuit board 11.

In this embodiment, the beveling portion 1*c* is formed as a flat surface, but the beveling portion 1*c* may be formed as a curved surface. Further, the beveling portions 1*c* may be formed only in the edge portions lying in the range where the input-output electrode 6*a* and 6*b* are formed.

In the dielectric filter of this embodiment, since the input-output electrodes 6*a* and 6*b* are formed only on the open end-face and the beveling portion, not formed on the mounting face, the deterioration of Q0, caused by the input-output electrodes 6*a* and 6*b,* are reduced. Since the input-output electrodes 6*a* and 6*b* are connected to the input-output pattern 12 on the circuit board 11 in the beveling portion 1*c,* the dielectric filter and the circuit substrate 11 can be connected steadily and securely.

Figure 6:
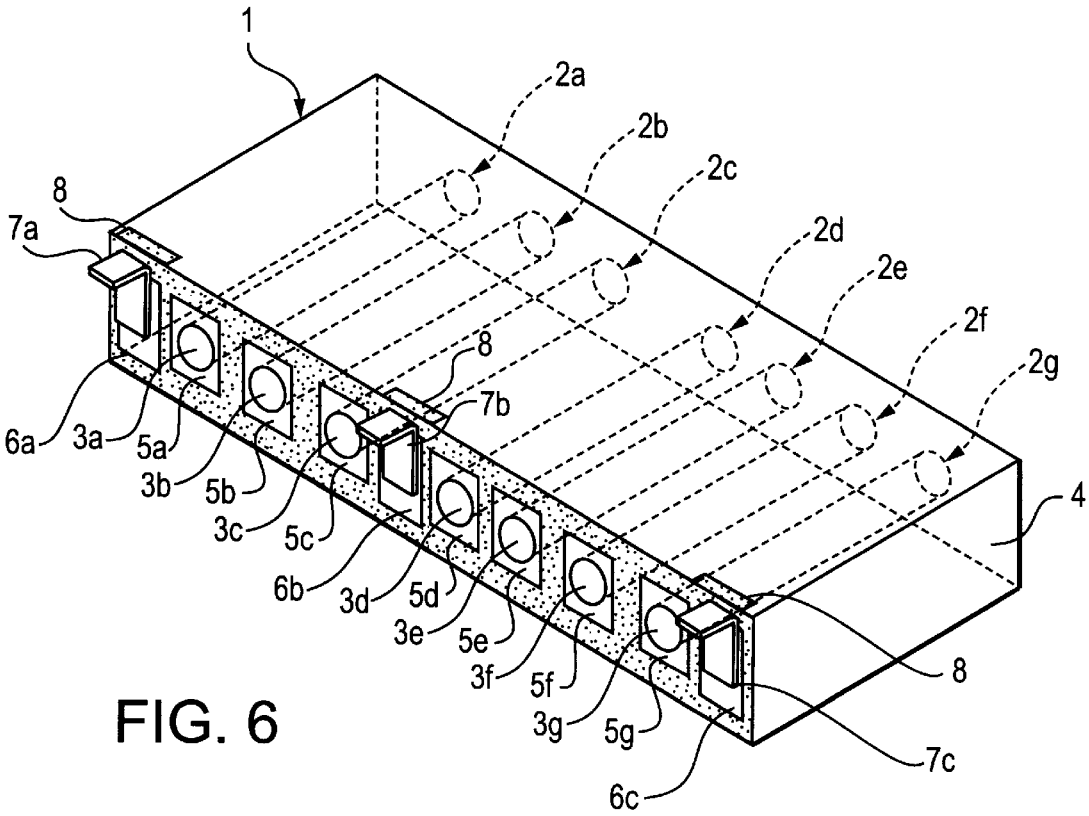
FIG. 6 is a perspective view of a dielectric duplexer according to a fourth preferred embodiment.

In the above-described respective embodiments, the description is carried out on one filter formed on the single dielectric block, but the present invention may be applied for at least two filter portions formed on the dielectric block as shown in FIG. 6.

The configuration of the dielectric duplexer according to the fourth preferred embodiment of the present invention is shown in FIG. 6. In this dielectric duplexer, a band-pass filter composed of three resonator stages on the transmission side and a band-pass filter composed of four resonator stages on the reception side are formed on the dielectric block 1 having a rectangular parallelepiped shape. The resonator holes 2*a,* 2*b* and 2*c* constituting resonators on the transmission filter side, and resonator holes 2*d,* 2*e,* 2*f* and 2*h* constituting resonators on the reception filter side are formed to elongate through the inside of the dielectric block 1 across the paired opposite end-faces. On the inner walls of the respective resonator hole resonator holes 2*a,* 2*b,* 2*c,* 2*d,* 2*e,* 2*f* and 2*g,* the inner conductors 3*a,* 3*b,* 3*c,* 3*d,* 3*e,* 3*f* and 3*g* are formed, respectively. The outer conductor 4 is formed on the outside of the dielectric block 1 excluding the one end-face. The end-face (the front side in FIG. 6) where the outer conductor 4 is not formed is an open end-face, and the other end-face is a short-circuiting end-face.

On the open end-face, formed are the coupling electrodes 5*a,* 5*b,* 5*c,* 5*d,* 5*e,* 5*f* and 5*g* connected to the inner conductors 3*a,* 3*b,* 3*c,* 3*d,* 3*e,* 3*f* and 3*g,* respectively, and separated from the outer conductor 4. The input-output electrode 6*a* is formed adjacently to the coupling electrode 5*a,* the input-output electrode 6*b* between the coupling electrodes 5*c* and 5*d,* and the input-output electrode 6*c* adjacently to the coupling electrode 5*g.* External coupling capacitances are given by the interelectrode capacitances between the coupling electrodes and the adjacent input-output electrodes, respectively.

The outer conductor 4 on the mounting face in the vicinity of the respective input-output electrodes 6*a* through 6*c* is partially excluded so that the outer conductor non-forming portions 8 are formed. The L-shaped conductive terminals 7*a,* 7*b,* and 7c are connected by soldering or the like to the input-output electrodes 6*a,* 6*b,* and 6*c,* correspondingly. The portions of the conductive terminals 7*a,* 7*b,* and 7*c* which are protuberant from the open end-face are attached to lie substantially in the same plane as the mounting face. The conductive terminal 7*a* functions as a transmission terminal, the conductive terminal 7*c* as a receiving terminal, and the conductive terminal 7*b* as an antenna terminal for common use in both of the filters.

This dielectric duplexer comprises two dielectric filters each having the same configuration as that of the second embodiment and formed on the dielectric block, and the same advantages as described in the first and second embodiments can be obtained.

In the above-described configuration of the dielectric duplexer, surface-mounting can be achieved steadily and securely without the conductive terminals being used, by excluding the edge portion between the open end-face and the mounting face as described in the third embodiment, and forming the input-output terminals which extends over the open end-face and the beveling portion.

The description of the above embodiments is carried out on the configurations in which one of the end-faces of the dielectric block is an end-face not having the outer conductor, and the respective resonators are coupled to each other through the coupling electrodes. However, the means for coupling the respective resonators is not limited to the above embodiments, and for example, a coupling hole and a coupling groove may be formed between the respective resonator holes. In an area excluding the input-output electrode forming area, the outer conductor may be formed. In this case, inner conductor non-forming portions are formed in the vicinity of the end-face, and by the capacitances produced across the formed gaps, the respective resonators can be coupled.

Further, in the respective embodiments, the input-output electrodes and the inner conductor are capacitance-coupled through the coupling electrodes, but the input-output electrodes and the inner conductor may be directly capacitance-coupled without the coupling electrodes being provided.

Further, in the above-described respective embodiments, for the cross-section of each resonator hole, a circular shape is shown, as an example, but the shape of each resonator hole, may have another shape such as a quadrangle, an ellipse, or the like, and also, the hole may be a so-called step-hole in which the cross-sectional shape and the inside diameter are changed midway.

Figure 7:
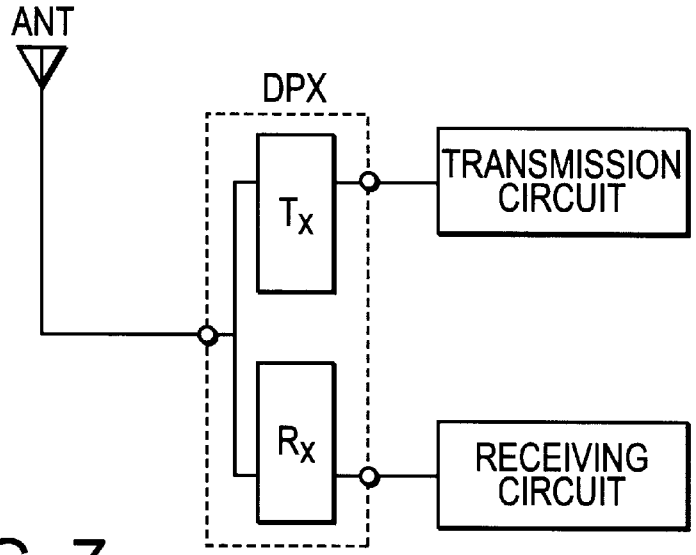
FIG. 7 is a block diagram showing a dielectric duplexer according to a fifth embodiment.
Figure 8:
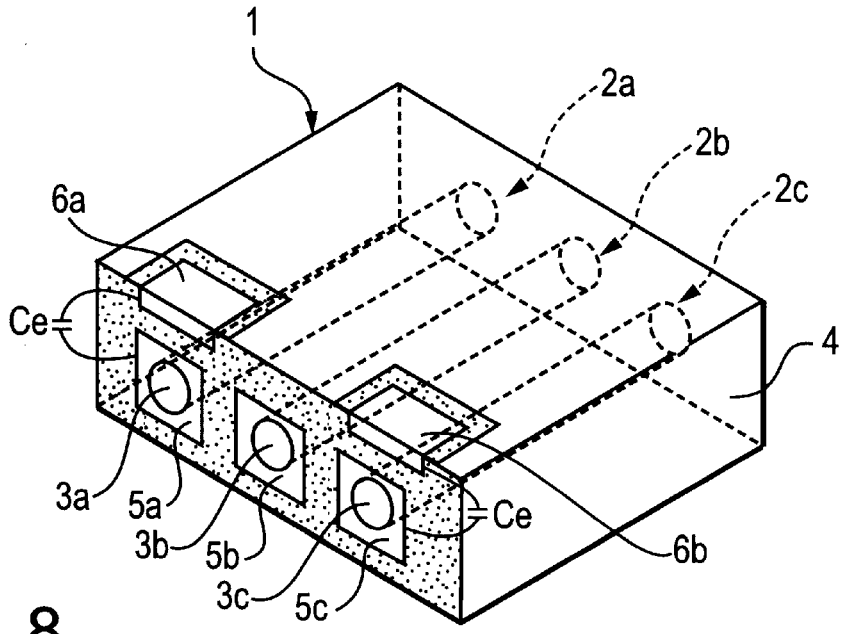
FIG. 8 PRIOR ART
FIG. 8 is a perspective view of a conventional dielectric filter.

In FIG. 7, shown is the configuration of the communication apparatus according to the fifth preferred embodiment of the present invention. In FIG. 7, ANT represents an antenna, DPX a duplexer, Tx a transmission filter, and Rx a receiving filter, respectively. The antenna terminal of the duplexer DPX is connected to the antenna ANT, the transmission terminal to a transmission circuit, and the receiving terminal to a receiving circuit, so that the communication apparatus is configured.

In this case, as the transmission filter Tx and the receiving filter Rx, the dielectric filter of the first, the second, or the third embodiment is available. As the duplexer DPX, the dielectric duplexer described in the fourth embodiment may be used. By use of the dielectric filter or the duplexer of the present invention, a communication apparatus with good characteristics can be realized.

As described above, in the dielectric filter or the dielectric duplexer of the present invention, the input-output electrodes are formed on the end-face of the dielectric block or on the end face and the beveling portion provided on the end-face, not formed on the sides of the dielectric block. Therefore, the deterioration of Q0, caused by the input-output electrodes, can be reduced.

Further, with the conductive terminals and the input-output electrodes formed on the beveling portion, surface-mounting on a circuit board can be achieved steadily and securely.

Thus, according to the present invention, dielectric filters and dielectric duplexers with improved insertion loss and attenuation characteristics can be obtained. Further, by mounting the dielectric filter or the duplexer of the present invention, a communication apparatus with good characteristics can be obtained.

The present invention is disclosed and described in reference to the preferred embodiments, and it is understood by one skilled in the art that the above-description and other modification is made without departing the spirit of the invention.

What is claimed is:

1. A dielectric filter comprising a dielectric block in a substantially rectangular parallelepiped shape, having a pair of opposite parallel end-faces and plural sides extending between the paired opposite end-faces, one of said plural sides being a mounting face;

plural resonator holes elongating through the inside of the dielectric block across the paired opposite end-faces;

inner conductors provided on inner walls of the plural resonator holes, respectively;

an outer conductor provided on the sides and one of the end-faces of the dielectric block;

a beveling portion provided in an edge portion between one of the paired opposite end-faces and the mounting face; and input-output electrodes provided to extend over the one of the paired opposite end-faces and the beveling portion, separated from the outer conductor, and capacitance-coupled to respective ones of the inner conductors.

2. A dielectric filter according to claim 1, wherein the outer conductor lying on the mounting face in the vicinity of the input-output electrodes is excluded.

3. A dielectric filter according to claim 1, wherein the other one of the paired opposite end-faces is an open end-face where the outer conductor is not provided.

4. A dielectric filter according to claim 1, wherein coupling electrodes connected to the inner conductors, correspondingly, are provided on the one of the paired opposite end-faces.

5. A dielectric duplexer comprising a dielectric block; and at least two filter sections in said dielectric block, said dielectric block being in a substantially rectangular parallelepiped shape, having a pair of opposite parallel end-faces and plural sides extending between the paired opposite end-faces, one of said plural sides being a mounting face;

at least one of said filter sections comprising:

plural resonator holes elongating through the inside of the dielectric block across the paired opposite end-faces;

inner conductors provided on inner walls of the plural resonator holes, respectively;

an outer conductor provided on the sides and one of the end-faces of the dielectric block;

a beveling portion provided in an edge portion between one of the paired opposite end-faces and the mounting face; and input-output electrodes provided to extend over the one of the paired opposite end-faces and the beveling portion separated from the outer conductor, and capacitance-coupled to respective ones of the inner conductors.

6. A dielectric duplexer according to claim 5, wherein the other one of the paired opposite end-faces is an open end-face where the outer conductor is not provided.

7. A dielectric duplexer according to claim 5, wherein the outer conductor lying on the mounting face in the vicinity of the input-output electrodes is excluded.

8. A dielectric duplexer according to claim 5, wherein coupling electrodes connected to the inner conductors, correspondingly, are provided on the one of the paired opposite end-faces.

9. A communication apparatus including at least one dielectric duplexer, said at least one dielectric duplexer comprising:

a dielectric block in a substantially rectangular parallelepiped shape, having a pair of opposite parallel end-faces and plural sides extending between the paired opposite end-faces, one of said plural sides being a mounting face;

at least two filter sections in said dielectric block, at least one of said filter sections comprising:

plural resonator holes elongating through the inside of the dielectric block across the paired opposite end-faces;

inner conductors provided on inner walls of the plural resonator holes, respectively;

an outer conductor provided on the sides and one of the end-faces of the dielectric block;

a beveling portion provided in an edge portion between one of the paired opposite end-faces and the mounting face; and input-output electrodes provided to extend over the one of the paired opposite end-faces and the beveling portion separated from the outer conductor, and capacitance-coupled to respective ones of the inner conductors.

10. A communication apparatus according to claim 9, wherein the outer conductor lying on the mounting face in the vicinity of the input-output electrodes is excluded.

11. A communication apparatus according to claim 9, wherein coupling electrodes connected to the inner conductors, correspondingly, are provided on the one of the paired opposite end-faces.

12. A communication apparatus according to claim 9, wherein the other one of the paired opposite end-faces is an open end-face where the outer conductor is not provided.

13. A communication apparatus including at least one dielectric filter, said at least one dielectric filter comprising:

a dielectric block in a substantially rectangular parallelepiped shape, having a pair of opposite parallel end-faces and plural sides extending between the paired opposite end-faces, one of said plural sides being a mounting face;

plural resonator holes elongating through the inside of the dielectric block across the paired opposite end-faces;

inner conductors provided on inner walls of the plural resonator holes, respectively;

an outer conductor provided on the sides and one of the end-faces of the dielectric block;

a beveling portion provided in an edge portion between one of the paired opposite end-faces and the mounting face; and input-output electrodes provided to extend over the one of the paired opposite end-faces and the beveling portion separated from the outer conductor, and capacitance-coupled to respective ones of the inner conductors.

14. A communication apparatus according to claim 13, wherein coupling electrodes connected to the inner conductors, correspondingly, are provided on the one of the paired opposite end-faces.

15. A communication apparatus according to claim 13, wherein the other one of the paired opposite end-faces is an open end-face where the outer conductor is not provided.

16. A communication apparatus according to claim 13, wherein the outer conductor lying on the mounting face in the vicinity of the input-output electrodes is excluded.

* * * * *